US005559307A

United States Patent [19]

Whitehead et al.

[11] Patent Number: 5,559,307

[45] Date of Patent: Sep. 24, 1996

[54] TWIST-ON CONNECTOR HAVING IMPROVED FINGER GRIP WINGS

[75] Inventors: James H. Whitehead, Collierville; Francis X. Lynch, Memphis, both, Tenn.

[73] Assignee: Thomas & Betts Corporation, Memphis, Tenn.

[21] Appl. No.: 268,428

[22] Filed: Jun. 30, 1994

[51] Int. Cl.[6] ..... H01R 4/22

[52] U.S. Cl. ..... 174/87; 174/138 F; 403/396; D13/150

[58] Field of Search ..... 174/87, 138 F; 403/396; D13/150

[56] References Cited

U.S. PATENT DOCUMENTS

| | | | |
|---|---|---|---|
| D. 186,596 | 11/1959 | Schinske | D26/10 |
| D. 186,597 | 11/1959 | Schinske | D26/10 |
| D. 186,600 | 11/1959 | Schinske | D26/10 |
| D. 223,611 | 5/1972 | Anderson | D26/1 |
| D. 315,139 | 3/1991 | Blaha | D13/150 |
| D. 315,143 | 3/1991 | Blaha | D13/150 |
| D. 339,106 | 9/1993 | McLaughlin et al. | D13/150 |
| 2,890,266 | 6/1959 | Bollmeier | 174/87 |
| 3,001,002 | 9/1961 | Schinske | 174/87 |
| 3,056,851 | 10/1962 | Scott | 174/87 |
| 3,075,038 | 1/1963 | Schinske | 174/87 |
| 3,097,257 | 7/1963 | Cheney | 174/87 |
| 3,107,273 | 10/1963 | Schinske et al. | 174/138 |
| 3,120,023 | 2/1964 | Ustin | 16/108 |
| 3,297,816 | 1/1967 | Waddington | 174/87 |
| 3,308,229 | 3/1967 | Burniston | 174/87 |
| 3,347,979 | 10/1967 | Hoffman | 174/87 |
| 3,519,970 | 7/1970 | Krup | 264/249 |
| 3,676,574 | 7/1972 | Johansson et al. | 174/87 |
| 3,875,324 | 4/1975 | Waddington et al. | 174/87 |
| 3,902,005 | 8/1975 | Norden | 174/87 |
| 4,104,482 | 8/1978 | Scott | 174/87 |
| 4,112,251 | 9/1978 | Scott | 174/87 |
| 4,150,251 | 4/1979 | Scott | 174/87 |
| 4,220,811 | 9/1980 | Scott | 174/87 |
| 4,227,040 | 10/1980 | Scott | 174/87 |
| 4,288,657 | 9/1981 | Swanson | 174/87 |
| 4,691,079 | 9/1987 | Blaha | 174/87 |
| 4,883,921 | 11/1989 | Legerius et al. | 174/87 |
| 4,924,035 | 5/1990 | Miller et al. | 174/87 |
| 5,001,301 | 3/1991 | Marr et al. | 174/87 |
| 5,023,401 | 6/1991 | Clifton | 174/87 |
| 5,113,037 | 5/1992 | King, Jr. et al. | 174/87 |
| 5,132,494 | 7/1992 | Burton et al. | 174/87 |
| 5,315,066 | 5/1994 | Spiteri, Sr. | 174/87 |

*Primary Examiner*—Kristine L. Kincaid
*Assistant Examiner*—Chau N. Nguyen
*Attorney, Agent, or Firm*—Michael L. Hoelter; Salatore J. Abbruzzese

[57] ABSTRACT

A twist-on electrical connector connects plural insulated electrical conductors. The connector may be manually twisted onto the conductors by an installer. The connector includes an outer insulative shell and an expandable spring held within the shell. The shell includes a pair of generally diametrically opposed wings which may be gripped by the installer to facilitate twisting of the connector onto the wires. The wings conform to the fingers of the installer to permit the easy gripping and twisting of the connector onto the conductors.

16 Claims, 4 Drawing Sheets

TWIST-ON CONNECTOR HAVING IMPROVED FINGER GRIP WINGS

FIELD OF THE INVENTION

The present invention relates generally to connectors used to terminate electrical wires. More particularly, the present invention relates to twist-on wire connectors which may be easily twisted onto the stripped ends of electrical conductors to effect electrical connection thereof.

BACKGROUND OF THE INVENTION

A well known and common product used to connect electrical wires is a twist-on or screw-on wire connector. These connectors are used to connect the stripped ends of two or more insulated or non-insulated conductors. Typically these twist-on wire connectors include a plastic insulating shell and a wire spring supported therein. The wire spring may be conical in shape so that when the connector is placed over the stripped ends of insulated electrical conductors and twisted thereon, the conductors are brought into electrical engagement with each other within the spring. In order to accommodate the stripped ends of the electrical conductors in the conical wire spring, the spring is constructed to resiliently radially expand. Such expansion permits two or more conductors to be supported within the conical spring.

Further, the resiliency of the spring securely holds the conductors together in the conical spring establishing electrical connection therebetween. As may be appreciated, mechanical securement of the conductors in the connector as well as the electrical connection therebetween is maintained by the radially inward compressive forces exerted by the expanded spring on the terminated conductors. Overexpansion of the spring during termination could cause the loosening of the connector over time, possibly resulting in an open connection between the conductors.

Attempts have been made to control the outward radial expansion of the conical wire spring during termination. One technique is to use the construction of the shell itself to exert a force against the expanding spring to control the rate of expansion of the spring. The prior art has seen numerous shell designs as well as materials to form the shell which attempt to provide such expansion control. U.S. Pat. No. 4,227,040 issued to Scott shows one example of shell modifications which attempt to control the rate of spring expansion. The connector shown in the '040 patent employs a plurality of longitudinally extending ribs spaced about the internal periphery of the shell. The ribs lie in engagement with the outer surface of the conical spring along the length thereof and retard the rate of expansion of the spring. However, it has been found that the particular shape and disposition of the ribs in the '040 patent provide such a degree of resistance to spring expansion that the connector may be difficult to readily twist onto electrical conductors especially in a repetitive installation setting.

In that regard, improvements have also been seen in wire connectors where the outside configuration of the shell is modified to render it easier to twist onto the conductors. One well known technique is to use diametrically opposed outwardly directed wings which fit between the thumb and forefinger of the installer to provide a degree of leverage to permit the twisting of the connector onto the connectors. The above-described '040 patent shows one example of the type of wings known in the prior art. It has been found that while the wings provide additional leverage useful in facilitating twisting of the connector on to the insulated wires, the particular shapes of wings known in the prior art are not ergonometrically comfortable for use by the installer. In situations where the installer has to make numerous such terminations in a short period of time, significant discomfort may be encountered by the installer. It is therefore desirable to provide an improved configuration for the shell which permits the installer to more comfortably terminate conductors with a twist-on wire connector.

SUMMARY OF THE INVENTION

It is an object of the present invention to provide a twist-on wire connector which may be more easily installed over the stripped ends of electrical conductors.

It is a further object of the present invention to provide a twist-on wire connector which may be easily manipulated by an installer to permit the comfortable twisting of the connector onto insulated wires.

It is a still further object of the present invention to provide a twist-on wire connector having externally directed wings which conform to the fingers of the installer to permit the easy twisting of the connector onto insulated wires.

In the efficient attainment of these and other objects the present invention provides a twist-on wire connector including an elongate connector housing or shell having a central cavity in communication with an open end. A spring element is supported within the cavity. The housing includes a pair of generally outwardly directed wings extending from diametrically opposed sides of the housing. Each wing defines an elongate finger surface for supporting the fingers of the installer. The finger surfaces are curved in the longitudinal direction so as to conform to the position of the thumb and the forefinger of the installer to permit the comfortable manual twisting of the connector onto the conductors.

As more particularly shown by way of the preferred embodiment herein, the outwardly directed wings of the present invention have a wing thickness which is narrower towards one end of the connector housing and wider toward the open end of the housing. This difference in wing thickness is achieved by providing an outwardly tapered gripping surface extending along a longitudinal extent of the housing.

DETAILED DESCRIPTION OF THE PREFERRED EMBODIMENTS

Figure 7:
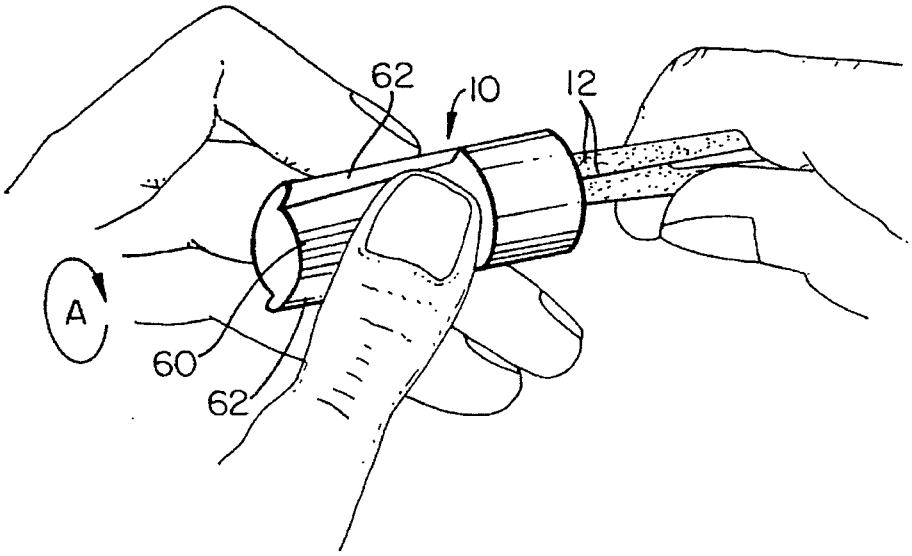
FIG. 7 shows the connector of FIG. 1 being manually installed onto a pair of stripped insulated electrical conductors.

With reference to FIG. 7, a wire connector 10 of the present invention is designed to be twisted onto the exposed stripped ends of electrically insulated conductors 12 to effect electrical connection therebetween. Connector 10 of the present invention is designed to be manually twisted or screwed onto conductors 12 which are held in side-by-side relationship. In a manner which is conventionally known, an installer would hold the connector 10 between the thumb and forefinger of one hand and twist or screw the connector onto the ends of the conductors 12 which may be held in the other hand.

Figure 1:
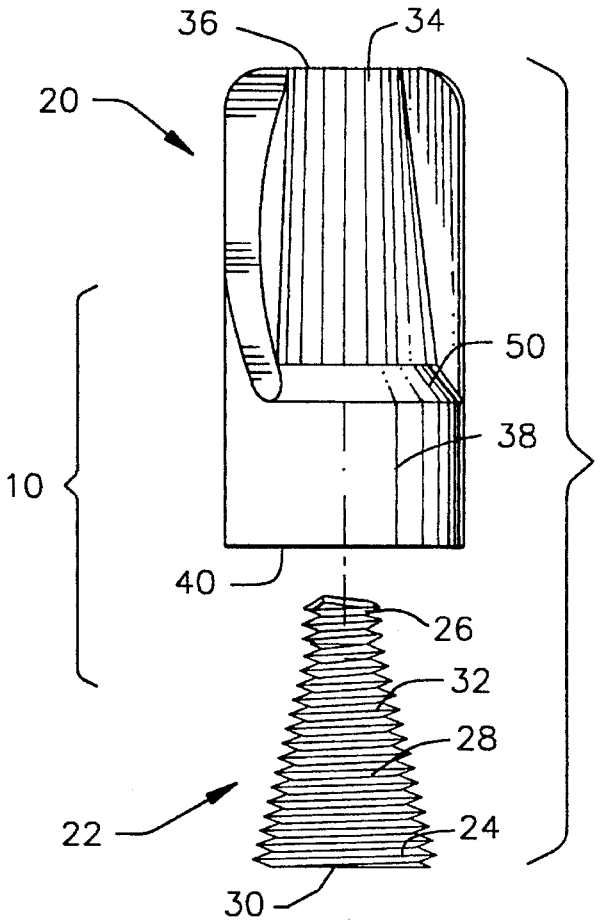
FIG. 1 is an exploded front elevation view of the connector of the present invention including an insulating cap or shell disposed over a coil spring.
Figure 2:
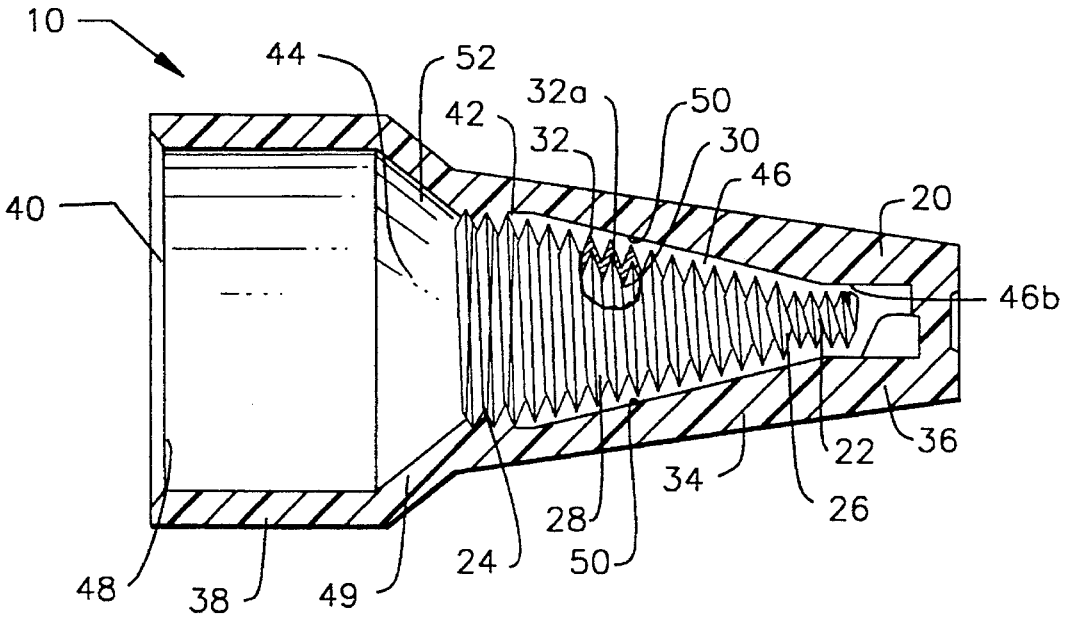
FIG. 2 is a longitudinal cross-section of the connector of FIG. 1 taken generally through the lines II—II of FIG. 4.
Figure 3:
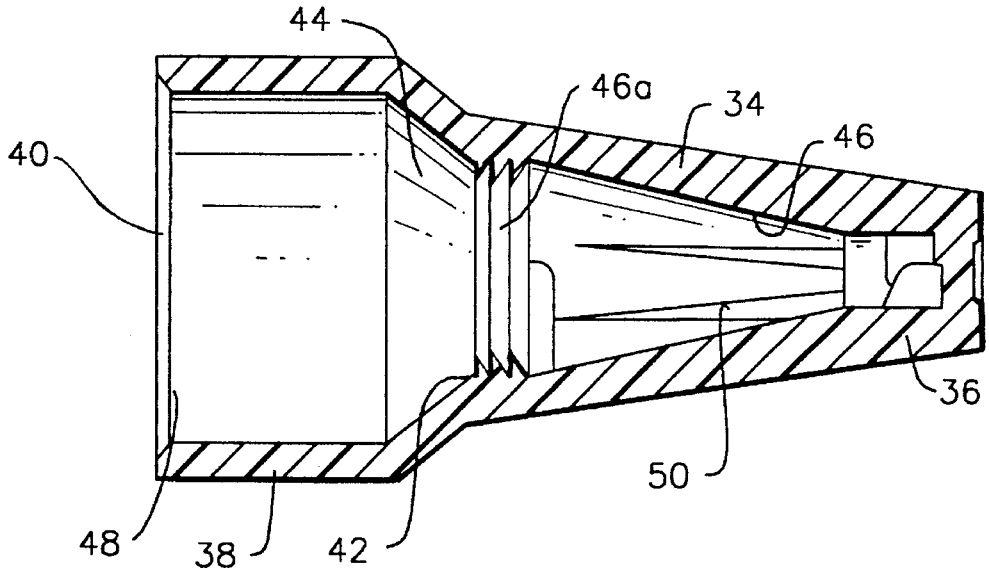
FIG. 3 is a longitudinal cross-section of the connector shell of FIG. 1 taken through the lines III—III of FIG. 4.

Referring now to FIGS. 1–3, connector 10 of the present invention is shown. Connector 10 is a two component device including an insulating cap or shell 20 and a wire coil spring 22. Shell 20 supports spring 22 therein in a manner which permits radial spring expansion thereof for securement over conductors 12.

Spring 22 is an elongate generally conically shaped member having an open wide end extent 24, an opposed narrow end extent 26 and a generally uniformly tapering central extent 28 therebetween. While spring 22 tapers in generally a linear fashion, it may include a slightly concave shape so that narrow end extent 26 flairs slightly outwardly to assist in securing spring 22 in shell 20 as will be described in further detail hereinbelow. Spring 22 defines a central passage 30 emanating from wider end extent 24 and terminating at narrow end extent 26. Passage 30 is designed to accommodate the stripped ends of conductors 12. Spring 22 is formed of a continuous helically wound metallic wire 32, which is conductive, although the conductivity of the wire 32 does not necessarily form part of the electrical connections between the conductors 12 that are to be connected. Wire 32 may have a diamond-shaped cross-section so as to provide edges **32*a* thereof which are adapted to cut into conductors 12 upon insertion thereinto enhancing mechanical engagement between the spring 22 and the conductors 12. The shape defined by the outer surface of spring 32 is preferably curved inwardly at the central extent 28, resulting in a waist or narrowed section. Also, in the preferred arrangement, the wire 32 forming spring 22** is plated with a suitable corrosion protection material, such as zinc.

Shell 20 is an elongate member formed of a suitably insulative molded thermoplastic material. In the present illustrative embodiment the particular material selected is nylon. Shell 20 includes a generally frustro-conically shaped upper portion 34 tapering towards a closed end 36. A wider lower skirt portion 38 is generally cylindrical in shape and includes an open end 40 opposed to closed end 36. The interior wall 42 of shell 20 defines an elongate bore 44 extending from closed end 36 to and communicating with open end 40. Bore 44 is generally divided into two bore sections; a first tapering bore section 46 coextensive with upper portion 34 and a wider cylindrical bore section 48 coextensive with lower portion 38. A centrally disposed tapered shell transition region 49 facilitates transition between wider lower skirt portion 38 and narrower upper portion 34 of shell 20. Similarly, bore 44 includes a centrally located tapered transition bore section 52 between tapering bore section 46 and cylindrical bore section 48.

As particularly shown with respect to FIG. 2, spring 22 is supported within bore 44 of shell 20. In order to provide such securement a lower extent **46*a* of first tapering bore section 46 is screw-threaded (FIG. 3) in a manner which generally matches the pitch of helically wound wire 32 forming spring 22. Thus, spring 22 may be screw inserted into shell 20 to provide securement therein. While threaded portion 46*a* is constructed to match the pitch of spring 22 to secure wide end extent 24 therein, it should be appreciated that other securement techniques, such as cross-threads or annular rings on the wall 42 of shell 20 may be provided. No threads at all, may be employed where wide extent 24 actually skives into interior wall 42 for securement therewith. Narrow end extent 26 of spring 22 is secured in frictional relationship in a narrow generally cylindrical end portion 46*b* of bore 44. The free end of spring extent 26 is formed to abut an inner surface on bore end portion 46*b* to provide a mechanical stop therebetween. Thus, in a manner well known in the twist-on connector art, spring 22 is in engagement with the internal wall 42 of shell 20 at both wider end extent 24 and narrow end extent 26. Tapering central extent 28 is generally spaced from interior wall 42 of shell 20 to define a free spring extent which is capable of radial expansion upon screw termination of connector 10 onto conductors 12 (FIG. 7**).

Figure 4:
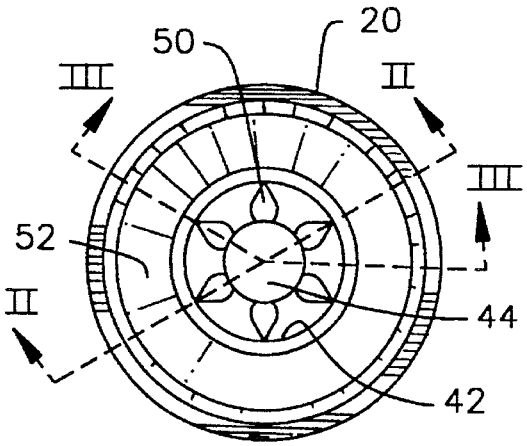
FIG. 4 is a bottom plan view of the connector shell of FIG. 1.

Referring now to FIGS. 2–4, the present invention provides by way of construction of internal wall 42 of shell 20 the ability to control the radial expansion of the central extent 28 of coil spring 22. Internal wall 42 adjacent frustro-conical upper portion 34 includes a plurality of circumferentially spaced ribs 50. Each rib 50 is an elongate member extending from portion **46*b* to threaded portion 46*a* of bore 44. Each rib 50 is generally inwardly radially directed toward central extent 28 of coil spring 22. As shown in FIG. 2, the distal radial extent of rib 50 is positioned such that space 46*c* is maintained between ribs 50 and central extent 28 of spring 22 so that central extent 28 maintains its free spring construction. As shown in FIGS. 3 and 4, each rib 50 inwardly tapers along its longitudinal extent towards the open end 40 of shell 20. Also the height and thickness of the radial extent of each rib 50 tapers downward toward open end 40 of shell 20. Thus, rib 50 uniformly reduces in all dimensions to a point adjacent threaded portion 46*a***.

Referring now to FIGS. 8 and 9A–9D, the ability to control radial expansion of spring 22 by the particular construction of ribs 50 is shown and described. Each rib 50 is inwardly directed, extending generally along a radius r of shell 20 emanating from a central origin point, O. The transverse cross-sectional shape of each rib 50 includes a base extent 53 lying along and attached to interior wall 42 and a pair of tapering sidewalls 54 and 56 having a height terminating at an apex or peak 58. In the configurations shown in FIGS. 8 and 9A–9D, the particular transverse cross-sectional shape of rib 50 is generally arcuate however other transverse cross-sectional shapes which emanate from a wider base and taper to a narrower peak or apex such as a triangle or trapezoid may also be employed.

Figure 8:
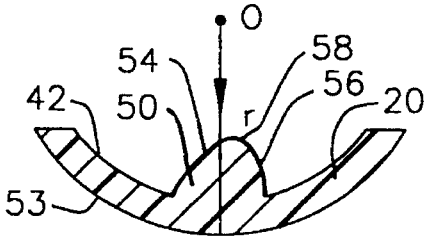
FIG. 8 is a sectional showing of a portion of the shell of FIG. 1.

In the embodiment shown in FIG. 8, the apex or peak 58, formed by the joining of tapered surfaces 54 and 56, is offset from the line defining radius r and passing centrally through bore extent 53. Thus, tapered surface 54 is longer than tapered surface 56 so that apex 58 is disposed to one side of radius, r. Further, the line defining radius, r intersects rib 50 at a location along tapered surface 54 which is proximate of apex 58.

Figure 9A:
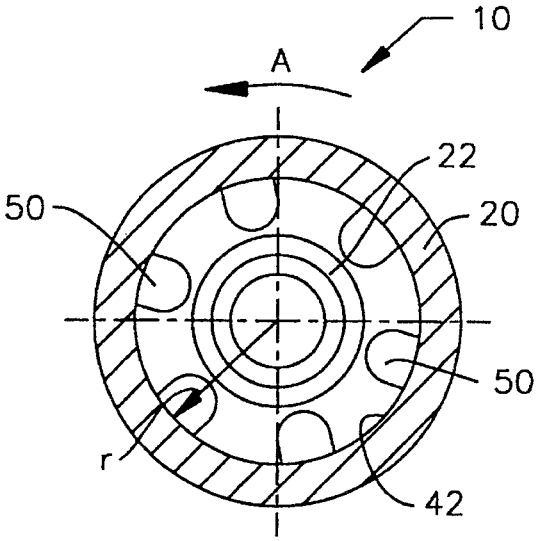
FIGS. 9A–9D show in schematic fashion, the effect on the shell ribs due to radial expansion of the coil spring of FIG. 1.
Figure 9B:
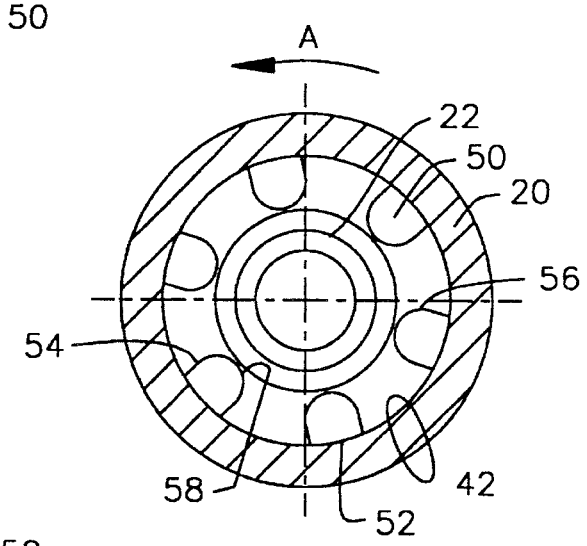
Figure 9C:
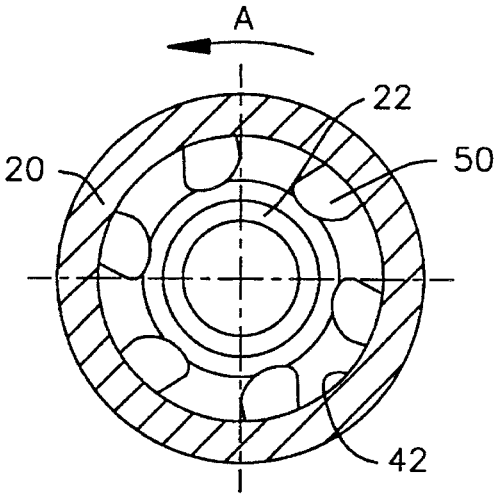
Figure 9D:
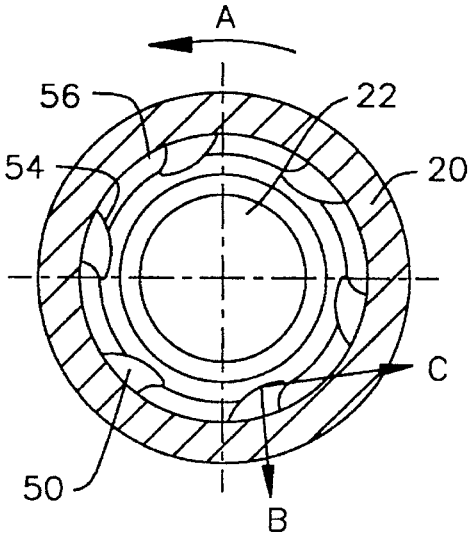

Referring specifically to FIGS. 9A–9D, schematically shown is the engagement of coil spring 22 with ribs 50 of shell 20. Generally it can be said that coil spring 22 expands circumferentially uniformly from central origin O. Thus expansion takes place uniformly in a radially outwardly directed manner. As connector 10 is rotated about the conductors (not shown) in the direction of arrow A, coil spring 22 will radially expand. Such radial expansion is shown successively in FIGS. 9A–9D. As the radial expansion of coil spring 22 reaches ribs 50, radial expanding spring 22 will contact ribs 50 along longer tapered surface 54 at a location proximate of apex 58. Continued radial expansion of coil spring 22 will cause deformable engagement with ribs 50. However, since apex 58 is offset from the radius of expansion, ribs 50 will not only deform or crush in a radial direction (arrow B) but will also deform or deflect towards the shorter tapered wall 56 (arrow C). The effects of such radial expansion is shown in FIG. 9D. The particular construction of ribs 50 permits the dual deformation thereof and provides superior control of the expansion of coil spring 22. By controlling the expansion of coil spring 22 inward spring pressure is continually exerted on conductors 12 held within passage 30 of coil spring 22 (FIG. 2) so that intimate engagement is provided between the conductors 12 supported therein. It can be seen from FIGS. 9A–9D that such spring engagement is maintained regardless of the degree of spring expansion of coil spring 22. Thus, connector 10 of the present invention may be used to connect a wide range of conductor sizes as well as various numbers of conductors. Further, as ribs 50 are constructed to be skewed from the line of radius r, thereby controlling spring expansion, the twisting of connector 10 onto conductors 12 in the direction of arrow A is more easily facilitated.

Figure 5:
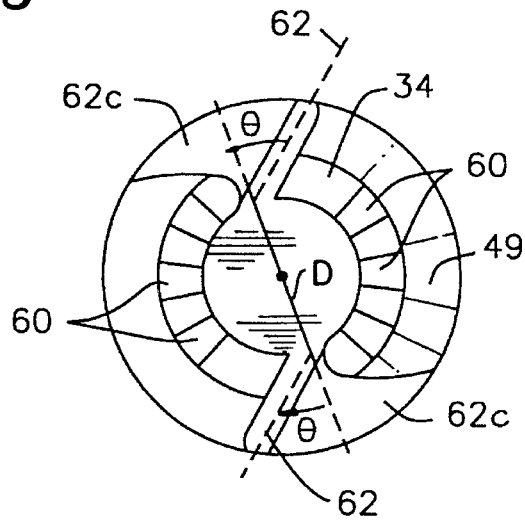
FIG. 5 is a top plan view of the connector of FIG. 1.
Figure 6:
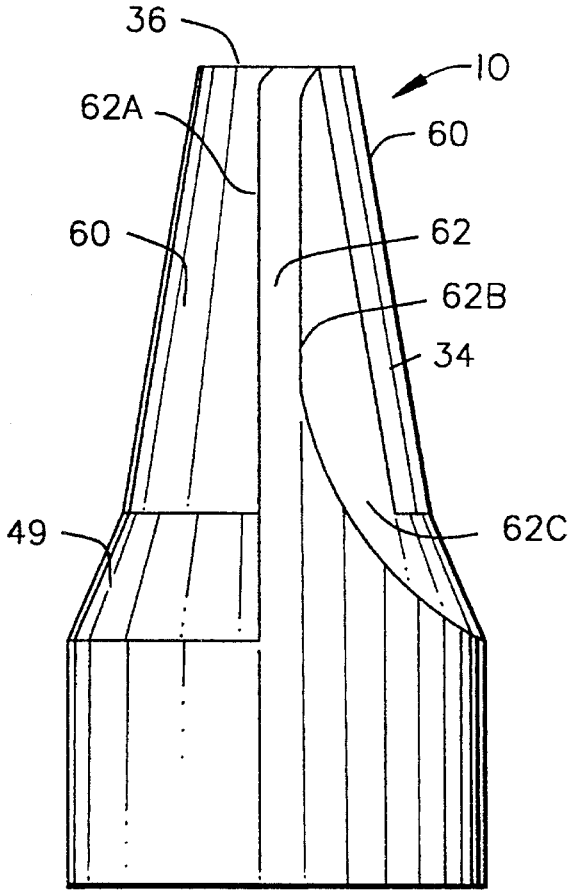
FIG. 6 is a side elevational showing of the connector of FIG. 1.

Referring now specifically to FIGS. 5, 6 and 7 in order to further assist the installer in twisting the connector 10 onto conductors 12, the present invention provides upper portion 34 of shell 20 with a plurality of longitudinally extending transversely spaced grooves 60 therealong. Grooves 60 extend from closed upper end 36 to transition region 49 to provide a tactile grasping surface which may be easily grasped and held by the installer. Grooves 60 may be of sufficient depth and spacing to provide a rough feel between the fingers of an installer.

Additionally, shell 20 includes a pair of generally diametrically opposed wings 62 extending outwardly from upper portion 34. As shown in FIG. 6 wings 62 extend longitudinally from upper surface 36 to and including the transition region 49 terminating at the upper extent of cylindrical portion 38. With additional reference to FIG. 5, wings 62 extend generally outwardly from locations at opposite ends of diameter, D. Wings 62 extend outwardly from such diametrically opposed locations at oppositely directed acute angles Θ from the diameter. Angle Θ is selected to be greater than 0° (lying along diameter D) so as to provide a more comfortable grip between the thumb and forefinger of the installer as shown in FIG. 7. Additionally, each wing 62 includes a pair of opposed surfaces, a first linear surface **62*a* and an opposed finger accommodating surface 62*b*. Finger accommodating surface 62*b* includes a lower extent 62*c* which curves outwardly and away from linear surface 62*a* providing an increased wing thickness thereat. The thickness of wing 62 adjacent curved extent 62*c* as well as the particular shape thereof provides a location which can be easily gripped by the installer as it ergonometrically conforms to the fingers of the installer as shown in FIG. 7 to facilitate the ease of twisting the connector 10 onto conductors 12 in rotational direction A. This allows the installer to make numerous terminations in a short period of time without experiencing discomfort or fatigue as the shape and size of the wings facilitates twisting connector 10 onto conductors 12**.

It should now be appreciated that the preferred embodiments described herein may be varied without departing from the contemplated scope of the invention. Various changes to the foregoing described and shown structures would now be evident to those skilled in the art. Accordingly, the particularly disclosed scope of the invention is set forth in the following claims.

What is claimed is:

1. A twist-on wire electrical connector comprising:

an elongate insulative connector housing having a closed upper end, an open lower end and a central cavity in communication with said open end; and a spring element supported in said cavity;

said housing having a pair of generally outwardly directed elongate wings extending along at least a longitudinal portion of said housing, each of said elongate wings having a first elongate wing surface and an opposed second elongate wing surface defining therebetween a wing thickness which is substantially wider at one end than at the other end thereof, said second wing surface including a curved portion curving away from said first wing surface.

2. A twist-on wire connector of claim 1 wherein said first wing surface is generally linear and wherein said second wing surface diverges away from said first wing surface towards said one end.

3. A twist-on wire connector of claim 1 wherein said closed upper end of said housing includes a circular cross-section and wherein said wings extend outwardly along diametrically opposed acute angles with respect to the diameter thereof.

4. A twist-on wire connector of claim 1 wherein said housing includes a generally elongate frustro-conical upper member extending from said closed upper end toward said open lower end and a generally cylindrical lower member in communication with said open lower end.

5. A twist-on wire connector of claim 4 wherein said wings are coextensive with said upper member of said housing.

6. A twist-on wire connector of claim 5 wherein said upper member includes spaced apart longitudinal grooves along the length thereof.

7. An electrical connector for twisting onto stripped ends of a pair of insulated conductors for effecting electrical connection of said conductors, said connector comprising:

an elongate hollow electrically insulative shell having a closed upper end and an opposed open end; and a spring contact member supported within said shell for electrically connecting said stripped ends of said insulated conductors;

said shell including a pair of longitudinal outwardly directed manual gripping wings extending from said closed upper end toward said open end, each of said wings having a first elongate wing surface and an opposed second elongate wing surface defining a transverse wing width which at least a portion thereof widens progressively substantially non-linearly from a point proximate said closed upper end toward said open end of said shell.

8. An electrical connector of claim 7 wherein said shell includes an upper generally frustro-conically shaped portion for accommodating said stripped ends of said pair of conductors and a lower generally cylindrical skirt portion which is wider than said upper frustro-conical portion for accommodating said insulated conductors.

9. An electrical connector of claim 8 wherein said wings extend along said upper portion of said shell.

10. An electrical connector of claim 9 wherein said wings each define a finger accommodating surface curving outwardly from adjacent said upper portion toward said skirt portion.

11. An electrical connector for manually twisting onto stripped ends of electrical conductors for effecting electrical connection therebetween, said connector comprising:

an elongate hollow insulative connector shell having an open end for insertion of said stripped ends of said conductors and a closed end;

a spring member supported within said shell and engageable with said stripped ends of said conductors for placing said conductors in electrical connection; and a pair of elongate wings extending outwardly from said shell to permit manual gripping of the shell between the thumb and forefinger of an installer to facilitate twisting of the shell onto the stripped ends of the conductors;

said wings each defining an elongate finger surface for supporting the fingers of the installer and a planar surface, the finger surface curving away from said planar surface from said closed end to said open end, said finger surface being curved so as to conform to the thumb and forefinger upon said manual twisting of said connector onto said conductors.

12. An electrical connector of claim 11 wherein said wings extend longitudinally from said closed end of said connector toward said open end.

13. An electrical connector of claim 12 wherein said wings have a tapering transverse dimension, divergently tapering towards said open end.

14. The twist-on electrical connector of claim 1, said second wing surface also including a planar portion.

15. The twist in electrical connector of claim 14, said planar portion being substantially parallel to said first wing surface.

16. The twist on electrical connector of claim 15, said planar portion being proximate said closed upper end and said curved portion being intermediate said planar portion and said open lower end.

* * * * *